US011715582B2

(12) United States Patent
Kojima et al.

(10) Patent No.: US 11,715,582 B2
(45) **Date of Patent: *Aug. 1, 2023**

(54) SHIELDED FLAT CABLE

(71) Applicant: SUMITOMO ELECTRIC INDUSTRIES, LTD., Osaka (JP)

(72) Inventors: Chiaki Kojima, Tochigi (JP); Tatsuo Matsuda, Tochigi (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/651,121

(22) Filed: Feb. 15, 2022

(65) Prior Publication Data

US 2022/0172861 A1 Jun. 2, 2022

Related U.S. Application Data

(63) Continuation of application No. 17/049,694, filed as application No. PCT/JP2019/017803 on Apr. 25, 2019, now Pat. No. 11,289,241.

(51) Int. Cl.
*H01B 7/08* (2006.01)
*H01B 7/02* (2006.01)
(Continued)

(52) U.S. Cl.
CPC ..... *H01B 7/0823* (2013.01); *H01B 7/0225* (2013.01); *H01B 7/08* (2013.01); *H01B 7/0861* (2013.01); *H01R 12/775* (2013.01); *H01R 12/79* (2013.01); *H01R 13/6471* (2013.01); *H01R 13/6581* (2013.01); *H01R 12/77* (2013.01);
(Continued)

(58) Field of Classification Search
CPC ..... H01B 7/08
See application file for complete search history.

(56) References Cited

U.S. PATENT DOCUMENTS 5,254,010 A 10/1993 Davis
5,658,164 A 8/1997 Parker
(Continued)

FOREIGN PATENT DOCUMENTS

CN 101840749 9/2010
JP H08-287733 11/1996
(Continued)

*Primary Examiner* — Chau N Nguyen
(74) *Attorney, Agent, or Firm* — IPUSA, PLLC

(57) ABSTRACT

A shielded flat cable includes multiple flat conductors arranged in parallel, a lower insulating layer provided on lower surfaces of the multiple conductors, a lower shield layer provided on a lower surface of the lower insulating layer, a lower protective layer provided on a lower surface of the lower shield layer, a lower contact portion that is exposed from the lower protective layer and provided to contact a second contact member of the connector, and that is electrically coupled to the lower shield layer, a terminal in which the multiple conductors are exposed at an end, and a reinforcing plate provided on the lower surface of the lower insulating layer and the lower surfaces of the multiple conductors at the terminal. The multiple conductors extend along the lower insulating layer and the reinforcing plate, and the lower contact portion and the terminal overlap in a side view.

6 Claims, 5 Drawing Sheets

(51) Int. Cl.

| | |
|---|---|
| ***H01R 12/79*** | (2011.01) |
| ***H01R 12/77*** | (2011.01) |
| ***H01R 13/6471*** | (2011.01) |
| ***H01R 13/6581*** | (2011.01) |
| *H01R 13/6582* | (2011.01) |

(52) U.S. Cl.
CPC ..... *H01R 12/771* (2013.01); *H01R 12/774* (2013.01); *H01R 13/6582* (2013.01)

(56) References Cited

U.S. PATENT DOCUMENTS

| | | | | |
|---|---|---|---|---|
| 11,289,241 | B2 * | 3/2022 | Kojima ..... | H01R 12/775 |
| 2009/0269968 | A1 | 10/2009 | Nemoto | |
| 2015/0364846 | A1 | 12/2015 | Chen et al. | |

FOREIGN PATENT DOCUMENTS

| | | |
|---|---|---|
| JP | 2002-150848 | 5/2002 |
| JP | 2002-231063 | 8/2002 |
| JP | 2008-027707 | 2/2008 |
| JP | 2009-266440 | 11/2009 |
| JP | 2011-008978 | 1/2011 |
| JP | 2011-146150 | 7/2011 |
| JP | 2011-198687 | 10/2011 |
| JP | 2014-207162 | 10/2014 |
| JP | 2017-139180 | 8/2017 |
| JP | 2018-181775 | 11/2018 |
| KR | 20100101422 | 9/2010 |

* cited by examiner

SHIELDED FLAT CABLE

The present application is a continuation application of U.S. patent application Ser. No. 17/049,694 filed on Oct. 22, 2020, which is the National Stage of International Application No. PCT/JP2019/017803, filed on Apr. 25, 2019, which is based on and claims priority to International Application No. PCT/JP2018/017258, filed on Apr. 27, 2018, the entire contents of which are incorporated herein by reference.

TECHNICAL FIELD

The present invention relates to a shielded flat cable.

BACKGROUND ART

Flexible flat cables (FFCs) are used to save space and to make easy connections in many fields including audio visual equipment, such as CD and DVD players, office automation equipment, such as copiers and printers, and internal wiring of other electronic and information equipment. Because the signal frequency used in the above-described equipment has increased, it is required to minimize the influence of noise. Thus, in recent years, shielded flat cables have been used.

For example, in the shielded flat cable disclosed in Patent Document 1, insulating resin films are bonded on upper and lower sides of multiple parallel conductors, one conductor surface of the conductors is exposed, and a reinforcing plate is bonded on a conductor surface opposite to the one conductor surface for reinforcement. At a terminal, the upper and lower surfaces and the side surface of the insulating resin films are covered with a metal foil film for shielding, and either the upper surface or the lower surface of the metal foil film is grounded to an electrical connector.

PRIOR ART DOCUMENTS

Patent Documents

[Patent Document 1] Japanese Laid-open Patent Publication No. 2011-198687

SUMMARY OF THE INVENTION

A shielded flat cable according to the present disclosure is inserted into a connector, and the shielded flat cable includes a plurality of flat conductors arranged in parallel, an upper insulating layer provided on upper surfaces of the plurality of conductors, an upper shield layer provided on an upper surface of the upper insulating layer, an upper protective layer provided on an upper surface of the upper shield layer, an upper contact portion exposed from the upper protective layer, the upper contact portion being provided to contact a first contact member of the connector, and the upper contact portion being electrically coupled to the upper shield layer, a lower insulating layer provided on lower surfaces of the plurality of conductors, a lower shield layer provided on a lower surface of the lower insulating layer, a lower protective layer provided on a lower surface of the lower shield layer, a lower contact portion exposed from the lower protective layer, the lower contact portion being provided to contact a second contact member of the connector, and the lower contact portion being electrically coupled to the lower shield layer, a terminal in which the plurality of conductors are exposed at an end in a longitudinal direction, and a reinforcing plate provided on the lower surface of the lower insulating layer and the lower surfaces of the plurality of conductors at the terminal. The plurality of conductors extend in a straight line along the lower insulating layer and the reinforcing plate, and the lower contact portion and the terminal overlap in a side view.

EMBODIMENT FOR CARRYING OUT THE INVENTION

Figure 1:
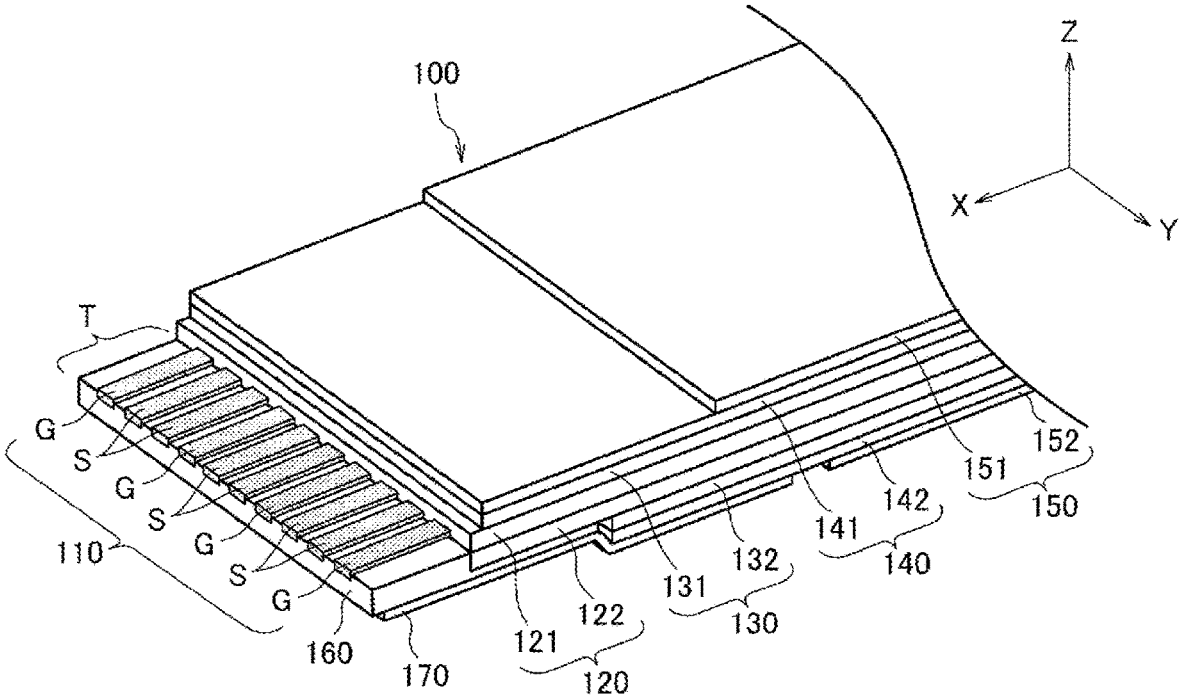
FIG. 1 is a perspective view illustrating a shielded flat cable according to a first embodiment.

Problem to Be Solved by the Present Disclosure

In order to increase the signal frequency used in shielded flat cables, it is necessary to use materials having low permittivity as an insulating resin film, but materials having low permittivity generally exhibit poor adhesion to other surfaces. Thus, it is difficult to obtain sufficient strength of a connection end through bonding a reinforcing plate over the insulating resin film.

Additionally, when metal foil films for shielding, provided on the upper and lower surfaces of the shielded flat cable, are grounded to the electrical connector from one side, the distance from the metal foil film on the upper surface to the electrical connector is different from the distance from the metal foil film on the lower surface to the electrical connector. This causes a balance of the upper and lower surfaces as a shield to be lost, and radiation noise may increase.

The present disclosure has been made in view of the above-described condition, and it is an object to provide a shielded flat cable that maintains the mechanical strength of a terminal and that reduces the characteristic impedance mismatch of a terminal.

Effect of the Present Disclosure

According to the present disclosure, the characteristic impedance mismatch of a terminal can be reduced while the mechanical strength of a terminal is maintained.

Description of Embodiments of the Present Disclosure

First, contents of embodiments of the present disclosure will be described by listing. A shielded flat cable of the present disclosure is as follows.

(1) A shielded flat cable for insertion into a connector, includes multiple flat conductors arranged in parallel, a first dielectric layer bonded on upper surfaces of the multiple conductors, a second dielectric layer bonded on an upper surface of the first dielectric layer, an upper shield layer bonded on an upper surface of the second dielectric layer, a third dielectric layer bonded on lower surfaces of the multiple conductors, a fourth dielectric layer bonded on a lower surface of the third dielectric layer, a lower shield layer bonded on a lower surface of the fourth dielectric layer, a terminal in which the multiple conductors are exposed on an end in a longitudinal direction, a reinforcing plate bonded on the lower surface of the third dielectric layer and the lower surfaces of the multiple conductors at the terminal, and a grounding member bonded on a lower surface of the reinforcing plate to be electrically coupled to the lower shield layer, wherein the grounding member extends underneath the terminal. In the shielded flat cable configured as above, the upper shield layer on an upper surface side of the conductors can contact a ground contact member of the connector and the lower shield layer on a lower surface side of the conductors can contact a ground contact member of the connector through the grounding member. Therefore, the difference between the transmission distance of the noise transmitted through the upper shield layer and the transmission distance of the noise transmitted through the lower shield layer is reduced, and the transmission distance of the noise in the shielded flat cable is leveled, thereby improving the transmission characteristics of the shielded flat cable, such as a near-end crosstalk (NEXT) value and a far-end crosstalk (FEXT) value. Additionally, the grounding member extends underneath the terminal to improve the impedance mismatch and further improve the transmission characteristics of the shielded flat cable, in comparison with a case in which the grounding member is not provided. Further, because the reinforcing plate can be firmly bonded on the exposed conductors, the mechanical strength of the terminal to contact the connector can be obtained.

(2) In the shielded flat cable described above, the conductors protrude further in the longitudinal direction than the grounding member. In the shielded flat cable as configured above, the conductors protrude further in the longitudinal direction than the grounding member, so that a contact point between the conductor and a conductor contact member of the connector can be provided in front of a contact point between the grounding member and the ground contact member of the connector in the longitudinal direction. Therefore, the impedance mismatch can be further improved.

(3) In the shielded flat cable described above, the upper shield layer along the terminal is formed as an uppermost surface, and the grounding member corresponding to the terminal is formed as a lowermost surface. In the shielded flat cable as configured above, an effect similar to the effect of the shielded flat cable described in (1) above can be achieved.

(4) The shielded flat cable of the present disclosure is a shielded flat cable that is inserted into a connector, and the shielded flat cable includes multiple flat conductors provided in parallel, a first dielectric layer bonded on upper surfaces of the multiple conductors, a second dielectric layer bonded on an upper surface of the first dielectric layer, an upper shield layer bonded on an upper surface of the second dielectric layer, a third dielectric layer bonded on lower surfaces of the multiple conductors, a fourth dielectric layer bonded on a lower surface of the third dielectric layer, a lower shield layer bonded on a lower surface of the fourth dielectric layer, a terminal in which the multiple conductors are exposed at an end in a longitudinal direction, and a reinforcing plate bonded on the lower surface of the third dielectric layer and the lower surfaces of the multiple conductors at the terminal, wherein the fourth dielectric layer and the lower shield layer extend underneath the terminal. In the shielded flat cable as configured above, the upper shield layer on an upper surface side of the conductors and the lower shield layer on a lower surface side of the conductors can individually come in contact with the ground contact members of the connector. Therefore, the difference between the transmission distance of the noise flowing through the upper shield layer and the transmission distance of the noise flowing through the lower shield layer is reduced, and the transmission distance of the noise in the shielded flat cable is leveled, thereby improving the transmission characteristics of the shielded flat cable, such as a near-end crosstalk (NEXT) value and a far-end crosstalk (FEXT) value. Further, the lower dielectric layer and the lower shield layer extend underneath the terminal to improve the impedance mismatch and thereby further improve the transmission characteristics of the shielded flat cable.

(5) In the shielded flat cable described above, the conductors protrude further in the longitudinal direction than the lower shield layer. In the shielded flat cable as configured above, the conductors protrude further in the longitudinal direction than the lower shield layer, so that a contact point between the conductor and the conductor contact member of the connector can be provided in front of a contact point between the lower shield layer and the ground contact member of the connector in the longitudinal direction. Therefore, the impedance mismatch can be further improved.

DETAILS OF EMBODIMENT OF THE PRESENT DISCLOSURE

First Embodiment of the Disclosure

Figure 2:
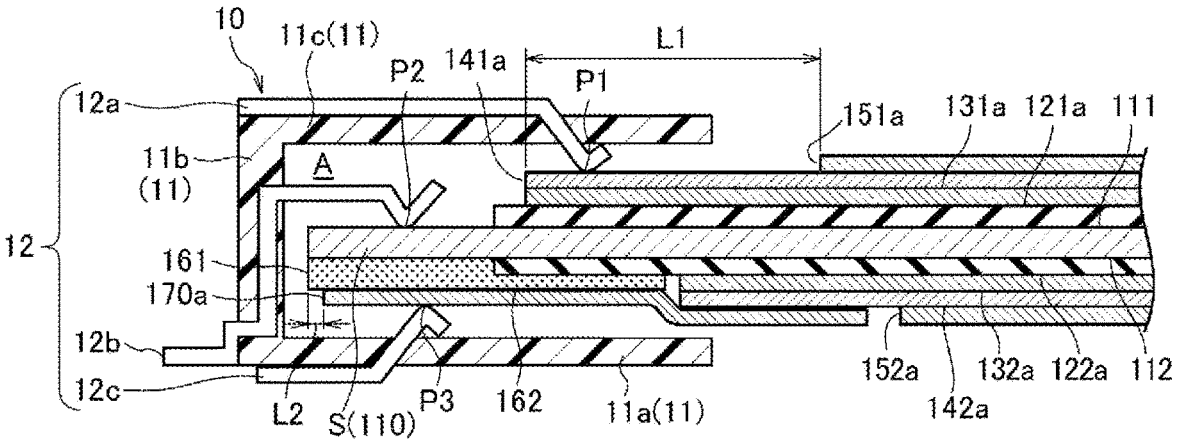
FIG. 2 is a side cross-sectional view illustrating a connection state of the shielded flat cable according to the first embodiment and a connector.

In the following, a shielded flat cable according to a first embodiment of the present disclosure will be described with reference to FIG. 1 and FIG. 2. FIG. 1 is a perspective view illustrating the shielded flat cable according to the first embodiment, and FIG. 2 is a side cross-sectional view illustrating a state of connection of the shielded flat cable according to the first embodiment and a connector. FIG. 2 is a cross-sectional view at a conductor used as a signal wire among conductors.

Here, the invention is not limited to these examples and is intended to be specified by the claims and to include all modifications within the meaning equivalent to the scope of the claims and within the scope of the claims. In the following description, a component referenced by the same reference numeral in different drawings is considered to be the same, and the description may be omitted.

[Overview of the Shielded Flat Cable]

As illustrated in FIG. 1, a shielded flat cable 100 includes a conductor 110 made of silver-plated copper foil, insulating layers 120 and dielectric layers 130 made of dielectric materials (e.g., a polyolefinic resin) having a higher permittivity than the conductor 110, shield layers 140 made of aluminum foil, and protective layers 150 made of insulating resin films.

The conductors 110 are flat members that extend in a longitudinal direction (i.e., in the X direction) and are arranged in parallel in a parallel direction orthogonal to the longitudinal direction (i.e., in the Y direction). The conductor 110 may be, for example, about 10 μm to 250 μm thick and may be about 0.2 mm to 0.8 mm wide. A pitch of the parallel conductors 110 is about 0.4 mm to 2.0 mm, and the insulating layers 120 are provided between the conductors 110 as illustrated in FIG. 1.

The conductors 110 are used as signal wires S and ground wires G in the shielded flat cable 100, and are arrayed such that two signal wires S and one ground wire G are repeated in the parallel direction, such as G-S-S-G-S-S-G-S-S-G.

The insulating layers 120 are layers to be bonded on both surfaces of the conductor 110 in a direction orthogonal to a surface of the parallel conductor 110 (i.e., the XY plane) (i.e., in the Z direction) by heating with a heating roller for joining. The insulating layers 120 include an upper insulating layer (i.e., a first dielectric layer) 121 bonded on an upper surface 111 of the conductor 110 and a lower insulating layer (i.e., a third dielectric layer) 122 bonded on a lower surface 112 of the conductor 110. The upper insulating layer 121 and the lower insulating layer 122 have the same thickness, and are about 9 μm to 100 μm thick.

The dielectric layers 130 are provided for adjusting the characteristic impedance of the shielded flat cable 100 and include an upper dielectric layer (i.e., a second dielectric layer) 131 bonded on an upper surface 121*a* of the upper insulating layer 121, and a lower dielectric layer (i.e., a fourth dielectric layer) 132 bonded on a lower surface 122*a* of the lower insulating layer 122.

The shield layers 140 include an upper shield layer 141 bonded on an upper surface 131*a* of the upper dielectric layer 131 and a lower shield layer 142 bonded on a lower surface 132*a* of the lower dielectric layer 132.

The protective layers 150 are members covering sides of the insulating layers 120, sides of the dielectric layers 130, and sides of the shield layers 140. The protective layers 150 electrically insulate the shielded flat cable 100 from the outside and protect the shielded flat cable 100 from damages caused by external force.

[Structure Around the Terminal]

Next, a structure around a terminal T formed at the end of the shielded flat cable 100 in the longitudinal direction and to be inserted into a connector 10 will be described. At the terminal T, the insulating layers 120, the dielectric layers 130, the shield layers 140, and the protective layers 150 are removed. Thus, at the terminal T, the conductors 110 are exposed and the upper shield layer 141 is famed as an uppermost surface.

The dielectric layers 130 and the shield layers 140 are further removed toward the center in addition to at the terminal T, and more of the lower dielectric layer 132 and the lower shield layer 142 are removed than the upper dielectric layer 131 and the upper shield layer 141. Thus, in side view, the upper dielectric layer 131 and the upper shield layer 141 protrude further in the longitudinal direction than the lower dielectric layer 132 and the lower shield layer 142. In the present embodiment, the amount of the dielectric layers 130 that is removed and the amount of the shield layers 140 that is removed are identical.

The protective layer 150 is provided such that the upper shield layer 141 and the lower shield layer 142 on a terminal side are exposed. A distance L1 between a front end 151*a* of an upper protective layer 151 for a cover on the upper shield layer 141 side and a front end 141*a* of the upper shield layer 141 is a distance in which a first ground contact member 12*a* of the connector 10 can come in contact with the upper shield layer 141 when the shielded flat cable 100 is inserted into the connector 10 described later. A lower protective layer 152 for a cover on the lower shield layer 142 side exposes more greatly than the upper protective layer 151. Thus, in a side view, the upper protective layer 151 protrudes further in the longitudinal direction than the lower protective layer 152.

At the terminal T, a reinforcing plate 160 made of a polyethylene terephthalate resin is bonded on a lower surface 112 of the conductor 110 to reinforce the exposed conductor 110. Thus, at the terminal T, only an upper surface 111 of the conductor 110 is exposed. Also, a front end 161 of the reinforcing plate 160 is approximately at the same position of a front end of the conductor 110.

The reinforcing plate 160 is also bonded on the lower insulating layer 122, thereby preventing the reinforcing plate 160 from being easily removed from the conductor 110 completely.

Further, at the terminal T, a grounding member 170 made of aluminum foil is bonded on a lower surface 162 of the reinforcing plate 160. The grounding member 170 protrudes further in the longitudinal direction than the insulating layers 120 and the dielectric layers 130 in a side view. The conductor 110 and the reinforcing plate 160 protrude further in the longitudinal direction than the grounding member 170 in a side view, and a distance L2 between a front end 161 of the reinforcing plate 160 and a front end 170*a* of the grounding member 170 is, for example, 0.5 mm.

The grounding member 170 is bonded on a lower surface 142*a* of the lower shield layer 142 and is electrically coupled to the lower shield layer 142. Thus, the grounding member 170 is formed as a lowermost surface at the terminal T and functions as a shield for the shielded flat cable 100.

[Relationship with the Connector]

Next, a connection relationship between the shielded flat cable 100 and the connector 10 will be described with reference to FIG. 2.

The connector 10 includes a casing 11 made of an electrically insulating resin and a contact member 12 fixed to the casing 11 and electrically coupled to the shielded flat cable 100. The casing 11 is a C-shaped member in a side view and includes a bottom 11*a* that contacts the a substrate to which the connector 10 is mounted, a side wall 11*b* rising from the bottom 11*a*, and a top 11*c* extending in a horizontal direction from a top of the side wall 11*b* and facing the bottom 11*a*.

The contact member 12 includes a first ground contact member 12*a* fixed to the top 11*c*, a conductor contact member 12*b* fixed to the side wall 11*b*, and a second ground contact member 12*c* fixed to the bottom 11*a*. The first ground contact member 12*a* is partially exposed within a cable insertion space A and includes a contact P1 protruding toward the bottom 11*a*. The conductor contact member 12*b* is also partially exposed within the cable insertion space A and includes a contact P2 protruding toward the bottom 11*a*. The second ground contact member 12*c* is partially exposed within the cable insertion space A formed by the bottom 11*a*, the side wall 11*b*, and the top 11*c*, and includes a contact P3 protruding toward the top 11*c*. The contact P1 of the first ground contact member 12*a* is famed at a position toward an opening relative to the contact P3 of the second ground contact member 12*c* in a side view, and the contact P3 of the second ground contact member 12*c* is formed at a position toward the opening relative to the contact P2 of the conductor contact member 12*b* in a side view.

The shielded flat cable 100 is inserted into the connector 10 such that the conductor 110 at the terminal T faces toward the top 11*c* of the connector 10. When the shielded flat cable 100 is fully inserted into the connector 10, the first ground contact member 12*a* of the connector 10 comes in contact with the upper shield layer 141 of the shielded flat cable 100, the conductor contact member 12*b* of the connector 10 comes in contact with the conductor 110 of the shielded flat cable 100, and the second ground contact member 12*c* of the connector 10 comes in contact with the grounding member 170 of the shielded flat cable 100.

Thus, the shielded flat cable 100 according to the present embodiment can reduce the difference between the transmission distance of the noise traveling through the upper shield layer 141 and the transmission distance of the noise traveling through the lower shield layer 142 by causing the upper shield layer 141 to contact the first ground contact member 12*a* of the connector 10 and causing the lower shield layer 142 on a lower surface 112 side of the conductor 110 to contact the second ground contact member 12*c* of the connector 10 through the grounding member 170.

Second Embodiment of the Disclosure

Figure 3:
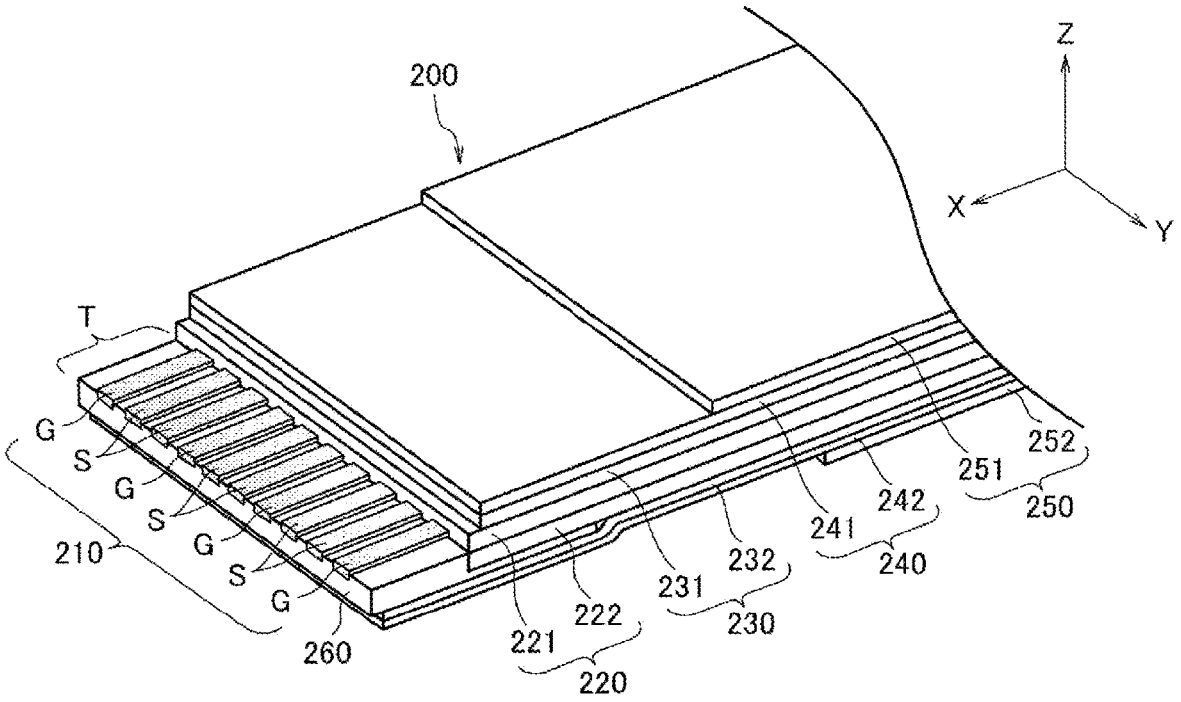
FIG. 3 is a perspective view illustrating a shielded flat cable according to a second embodiment.
Figure 4:
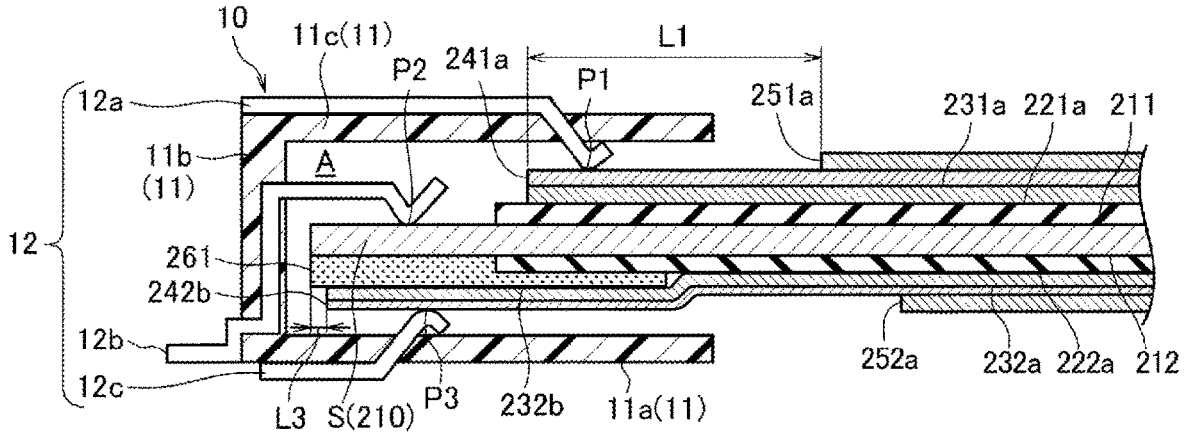
FIG. 4 is a side cross-sectional view illustrating a connection state of the shielded flat cable according to the second embodiment and the connector.

Next, a shielded flat cable, which is a second embodiment of the present disclosure, will be described with reference to FIG. 3 and FIG. 4. FIG. 3 is a perspective view illustrating the shielded flat cable according to the second embodiment, and FIG. 4 is a side cross-sectional view illustrating a connection state of the shielded flat cable according to the second embodiment and the connector. FIG. 4 is a cross-sectional view of a conductor used as a signal wire among conductors.

As illustrated in FIG. 3, the shielded flat cable 200 also includes a conductor 210 made of silver-plated copper foil, insulating layers 220 and dielectric layers 230 made of dielectric materials (e.g., a polyolefinic resin) having a higher permittivity than the conductor 210, shield layers 240 made of aluminum foil, and protective layers 250 made of insulating resin films.

The conductor 210 and the insulating layers 220 are similar to the conductor and the insulating layers in the shielded flat cable 100 of the first embodiment and the description will be omitted. Additionally, the dielectric layers 230, the shield layers 240, and the protective layers 250 are similar to the dielectric layers, the shield layers, and the protective layers in the shielded flat cable 100 according to the first embodiment, except for an area around the terminal T. Therefore, the description will be omitted.

[Structure Around the Terminal]

Next, a structure around the terminal T, which is formed at an end of the shielded flat cable 200 in the longitudinal direction and which is inserted into the connector 10, will be described. At the terminal T, the insulating layers 220, the upper dielectric layer 231, the upper shield layer 241, and the protective layers 250 are removed. Thus, at the terminal T, an upper surface 211 of the conductor 210 is exposed. The lower dielectric layer 232 and the lower shield layer 242 are also partially removed at the terminal T. Therefore, in side view, the conductor 210 protrudes further in the longitudinal direction than the lower dielectric layer 232 and the lower shield layer 242.

At the terminal T, a reinforcing plate 260 made of a polyethylene terephthalate resin is inserted between a lower surface 212 of the conductor 210 and an upper surface 232*b* of the lower dielectric layer 232 in order to reinforce the conductor 210 of which the upper surface is exposed. The reinforcing plate 260 is also bonded on the lower insulating layer 222. That is, the reinforcing plate 260 is bonded on the lower surface 212 of the conductor 210, a lower surface 222*a* of the lower insulating layer 222, and the upper surface 232*b* of the lower dielectric layer 232. A front end 261 of the reinforcing plate 260 is approximately at the same position of the front end of the conductor 210. A distance L3 between the front end 261 of the reinforcing plate 260 and the front end 242*b* of the lower shield layer 242 is, for example, 0.5 mm.

The adhesive strength between the reinforcing plate 260 and the lower insulation layer 222 is greater than the adhesive strength between the reinforcing plate 260 and the conductor 210, thereby preventing the reinforcing plate 260 from being easily removed from conductor 210 completely.

The upper dielectric layer 231 and the upper shield layer 241 are further removed toward the center in addition to the terminal T. Thus, in a side view, the lower dielectric layer 232 and the lower shield layer 242 protrude further in the longitudinal direction than the upper dielectric layer 231 and the upper shield layer 241.

The protective layers 250 are provided such that the upper shield layer 241 and the lower shield layer 242 on a terminal side are exposed. A distance L1 between a front end 251*a* of the upper protective layer 251 for a cover on an upper shield layer 241 side and a front end 241*a* of the upper shield layer 241 is the distance in which the first ground contact member 12*a* of the connector 10 can come in contact with the upper shield layer 241 when the shielded flat cable 200 is inserted into the connector 10 described below, as in the shielded flat cable 100 of the first embodiment. The lower protective layer 252 for a cover on a lower shield layer 242 side exposes more greatly than the upper protective layer 251. Therefore, in a side view, the upper protective layer 251 protrudes further in the longitudinal direction than the lower protective layer 252.

[Relationship with the Connector]

Next, a connection relationship between the shielded flat cable 200 and the connector 10 will be described with reference to FIG. 4.

The shielded flat cable 200 is inserted into the connector 10 such that the conductor 210 of the terminal T faces a top 11*c* side of the connector 10. When the shielded flat cable 200 is fully inserted into the connector 10, the first ground contact member 12*a* of the connector 10 comes in contact with the upper shield layer 241 of the shielded flat cable 200, the conductor contact member 12*b* of the connector 10 comes in contact with the conductor 210 of the shielded flat cable 200, and the second ground contact member 12*c* of the connector 10 comes in contact with the lower shield layer 242 of the shielded flat cable 200.

Thus, in the shielded flat cable 200 according to the present embodiment, the upper shield layer 241 comes in contact with the first ground contact member 12*a* of the connector 10, and the lower shield layer 242 on a lower surface 212 side of the conductor 210 comes in contact with the second ground contact member 12*c* of the connector 10, thereby reducing the difference between the transmission distance of the noise traveling through the upper shield layer 241 and the transmission distance of the noise traveling through the lower shield layer 242.

[Transmission Characteristics]

Next, the transmission characteristics of the shielded flat cable according to the present disclosure will be described. The shielded flat cable 100 according to the first embodiment and the shielded flat cable 200 according to the second embodiment differ in that a member contacting the second ground contact member 12*c* of the connector 10 is two members (i.e., the grounding member 170 and the lower shield layer 142 of the first embodiment) or one member (i.e., the lower shield layer 242 of the second embodiment), and the transmission characteristics are substantially equivalent. Therefore, the shielded flat cable 200 according to the second embodiment will be referred to in the following description.

[NEXT and FEXT Characteristics]

Figure 5:
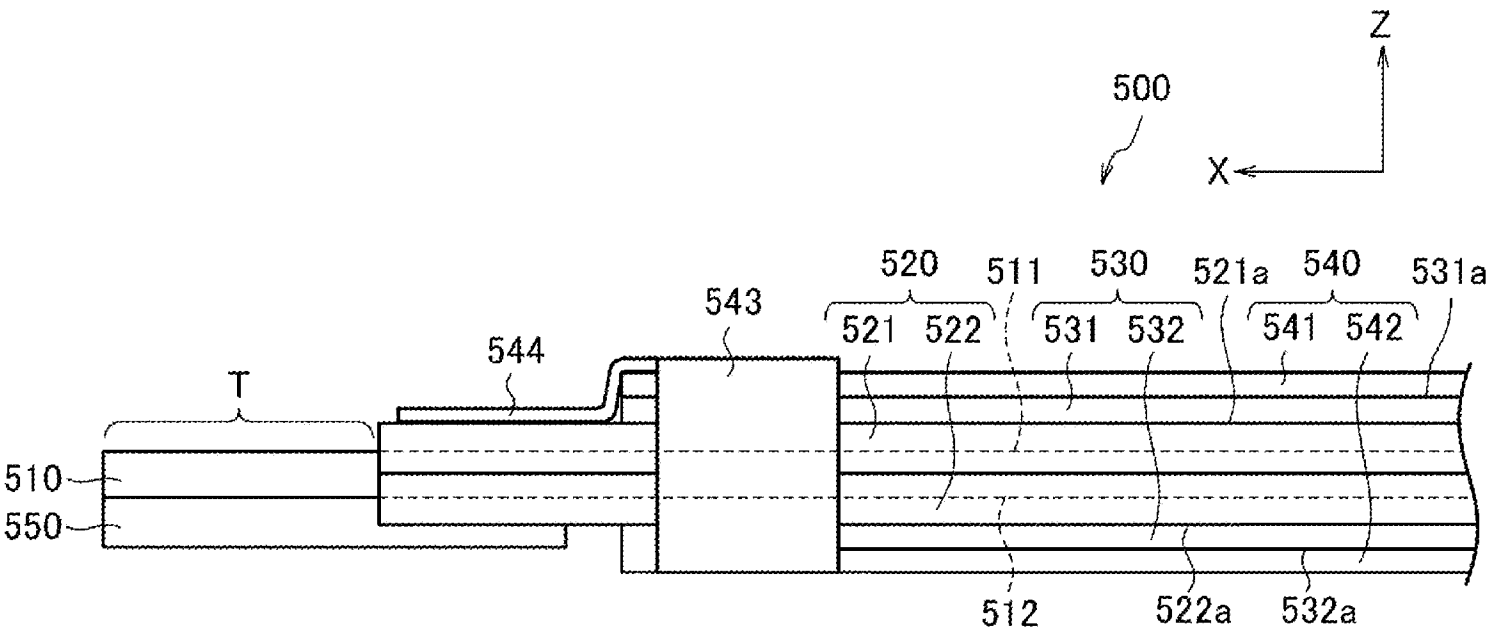
FIG. 5 is a side view illustrating a shielded flat cable that is a first comparative example of the shielded flat cable of the present disclosure.
Figure 6A:
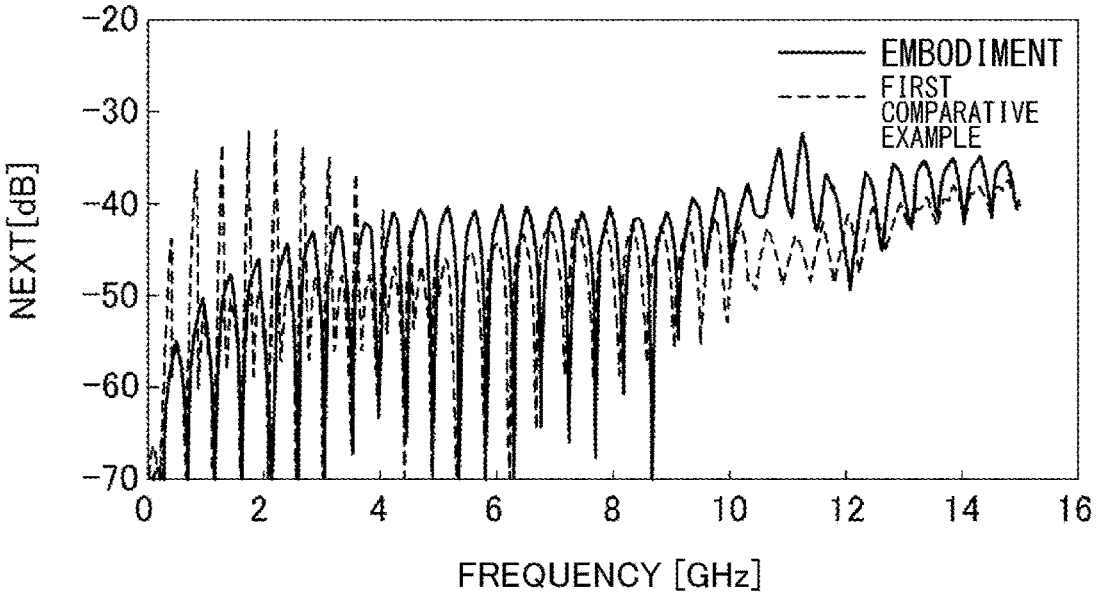
FIG. 6A is a graph illustrating NEXT characteristics of the shielded flat cable of the present disclosure and the shielded flat cable of the first comparative example.
Figure 6B:
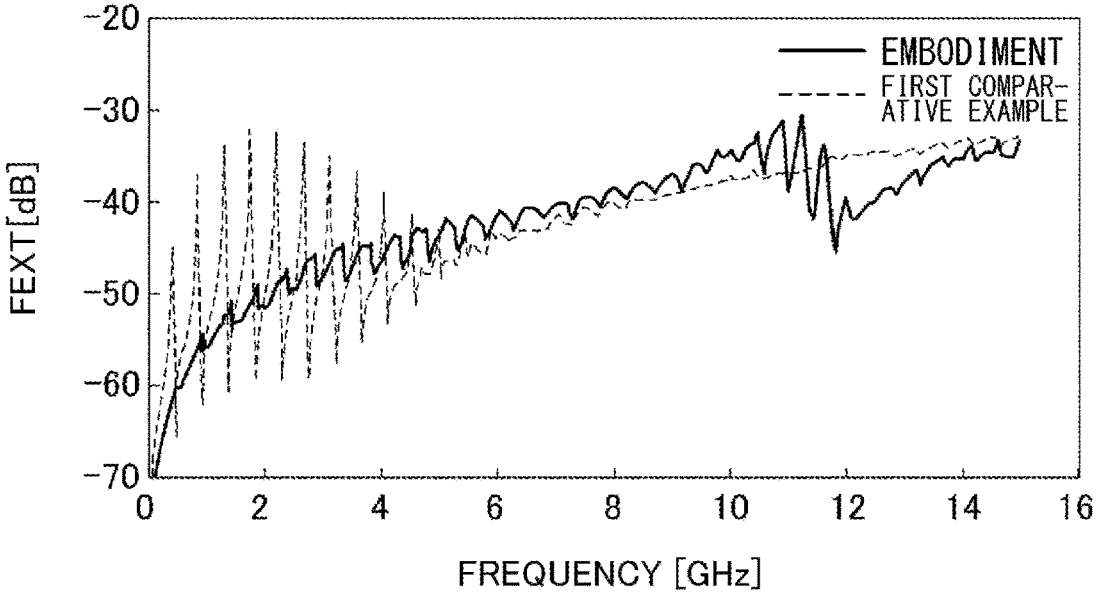
FIG. 6B is a graph illustrating FEXT characteristics of the shielded flat cable of the present disclosure and the shielded flat cable of the first comparative example.

First, the characteristics of the NEXT and FEXT values will be described with reference to FIGS. 5 to 6B. FIG. 5 is a side view illustrating a shielded flat cable according to a first comparative example of the shielded flat cable of the present disclosure, FIG. 6A is a graph illustrating the NEXT characteristics of the shielded flat cable of the present disclosure and the shielded flat cable of the first comparative example, and FIG. 6B is a graph illustrating the FEXT characteristics of the shielded flat cable of the present disclosure and the shielded flat cable of the first comparative example.

First, a shielded flat cable 500, which is the first comparative example, will be described with reference to FIG. 5. The shielded flat cable 500 includes a conductor 510 that has a planar cross-section and that extends in the X-axis direction, insulating layers 520 bonded on both sides of the conductor 510 in a direction orthogonal to the X-direction (i.e., in the Z-direction), dielectric layers 530 bonded on both sides of the insulating layers 520, and shield layers 540 bonded on both sides of the dielectric layers 530 in the Z-direction, as illustrated in FIG. 5. The insulating layers 520 include an upper insulating layer 521 bonded on an upper surface 511 of the conductor 510 and a lower insulating layer 522 bonded on a lower surface 512 of the conductor 510. The dielectric layers 530 include an upper dielectric layer 531 bonded on an upper surface 521*a* of the upper insulating layer 521 and a lower dielectric layer 532 bonded on a lower surface 522*a* of the lower insulating layer 522. The shield layers 540 include an upper shield layer 541 bonded on an upper surface 531*a* of the upper dielectric layer 531 and a lower shield layer 542 bonded on a lower surface 532*a* of the lower dielectric layer 532. The material and specification of the conductor 510, the insulating layer 520, the dielectric layer 530, and the shield layer 540 are the same as the material and specification of the shielded flat cable 200 according to the second embodiment.

Further, at a terminal T, which is an end of the shielded flat cable 500 in the longitudinal direction, the insulating layers 520, the dielectric layers 530, and the shield layers 540 are removed and the conductor 510 is exposed. A reinforcing plate 550 is bonded on the lower surface 512 of the exposed conductor 510 to reinforce the conductor 510. The dielectric layers 530 and the shield layers 540 are removed toward the center in addition to at the terminal T, and the amounts of removal are identical.

The shield layers 540 further include a coupling part 543 coupling the upper shield layer 541 and the lower shield layer 542 and a contact 544 extending from the coupling part 543 toward the terminal T.

That is, in the shielded flat cable 500 of the first comparative example, the upper shield layer 541 and the lower shield layer 542 are electrically coupled and grounded to the connector only on an upper shield layer 541 side.

Next, the transmission characteristics of the shielded flat cable 200 of the second embodiment of the present disclosure and the shielded flat cable 500 of the first comparative example will be described with reference to FIG. 6A and FIG. 6B. FIG. 6A and FIG. 6B indicate the attenuation amount of a signal with respect to the frequency, with solid lines for the present embodiment of the disclosure and dotted lines for the first comparative example.

As illustrated in FIG. 6A, with respect to the NEXT, crosstalk in the frequency band approximately smaller than or equal to 4 GHz is significantly reduced in the embodiment of the present disclosure as compared to the first comparative example. As illustrated in FIG. 6B, with respect to the FEXT, crosstalk in the frequency band approximately smaller than or equal to 5 GHz is significantly reduced in the embodiment of the present disclosure as compared to the first comparative example.

[Characteristic Impedance]

Next, the transmission characteristics of the shielded flat cable 200 of the second embodiment of the present disclosure and a shielded flat cable 600 of a second comparative example will be described with reference to FIG. 7.

The shielded flat cable 600 of the second comparative example is similar to the shielded flat cable 200 of the second embodiment except that the lower dielectric layer 232 and the lower shield layer 242 of the shielded flat cable 200 of the second embodiment do not extend to the terminal T.

Figure 7:
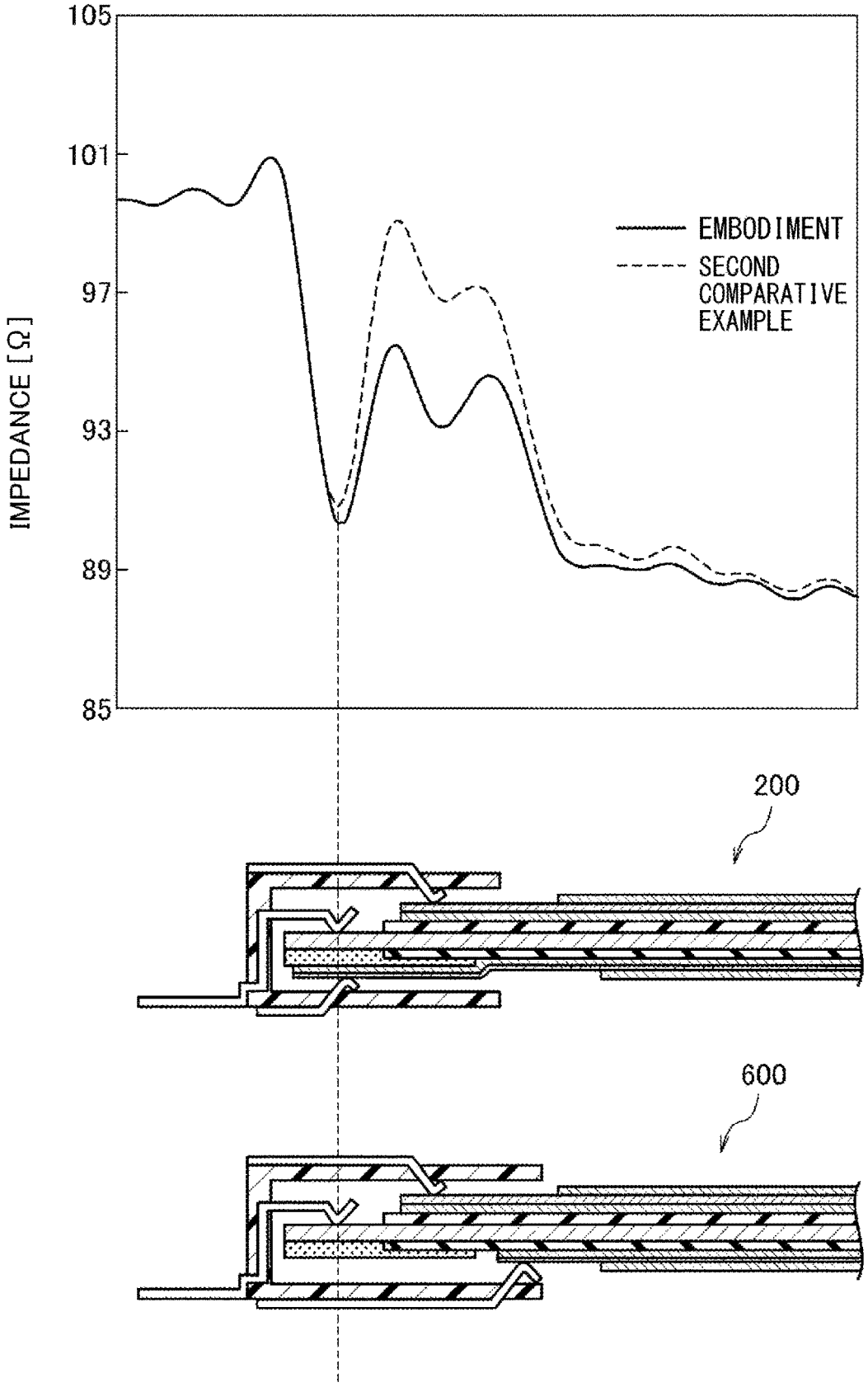
FIG. 7 is a graph illustrating impedance characteristics of the shielded flat cable of the present disclosure and a shielded flat cable of a second comparative example.

As illustrated in FIG. 7, the characteristic impedance of the shielded flat cable is improved at the terminal T in the embodiment of the present disclosure compared with the second comparative example.

MODIFIED EXAMPLES

The embodiments of the present disclosure have been described, but the present disclosure is not limited to the above-described embodiments.

For example, in the first embodiment and the second embodiment, the protective layer is provided, but may be removed. In the first embodiment, the lower protective layer 152 and the grounding member 170 are spaced apart, but the grounding member 170 may be covered by the lower protective layer 152.

For example, in the first embodiment and the second embodiment, the conductor is silver-plated copper foil, but is not limited to this. As long as the conductor is conductive, the conductor may be a general copper foil or a tin-plated wire, for example.

For example, in the first embodiment and the second embodiment, the conductors are used as the signal wire S and the ground wire G, and two signal wires S and one ground wire G are repeatedly arrayed in the parallel direction, such as G-S-S-G-S-S-G-S-S-G. However, the array is not limited to this. For example, the array may be G-S-S-S-G-G-S-S-G or may be G-G-S-S-G-G-S-S-G-G.

Each element provided by the embodiments described above can be combined as long as the combination is technically possible, and these combinations are included within the scope of the invention as long as features of the invention are included.

DESCRIPTION OF THE REFERENCE NUMERALS

10 connector
11 casing
11*a* bottom
11*b* side wall
11*c* top
12 contact member
12*a* first ground contact member
12*b* conductor contact member
12*c* second ground contact member
100, 200 shielded flat cable

110, 210 conductor
111, 211 upper surface
112, 212 lower surface
120, 220 insulating layer
121, 221 upper insulating layer (first dielectric layer)
121*a*, 221*a* upper surface
122, 222 lower insulating layer (third dielectric layer)
122*a*, 222*a* lower surface
130, 230 dielectric layer
131, 231 upper dielectric layer (second dielectric layer)
131*a*, 231*a* upper surface
132, 232 lower dielectric layer (fourth dielectric layer)
132*a*, 232*a* lower surface
232*b* upper surface
140, 240 shield layer
141, 241 upper shield layer
141*a*, 241*a* front end
142, 242 lower shield layer
142*a* lower surface
242*b* front end
150, 250 protective layer
151, 251 upper protective layer
151*a*, 251*a* front end
152, 252 lower protective layer
152*a*, 252*a* front end
160, 260 reinforcing plate
161, 261 front end
162, 262 lower surface
170 grounding member
170*a* front end
500, 600 shielded flat cable of comparative example
510 conductor
511 upper surface
512 lower surface
520 insulating layer
521 upper insulating layer
521*a* upper surface
522 lower insulating layer
522*a* lower surface
530 dielectric layer
531 upper dielectric layer
531*a* upper surface
532 lower dielectric layer
532*a* lower surface
540 shield layer
541 upper shield layer
542 lower shield layer
543 connection
544 contact
550 reinforcing plate
T terminal
G ground wire
S signal wire
A cable insertion space
L1 distance between front end of upper protective layer and front end of upper shield layer
L2 distance between front end of the reinforcing plate and front end of grounding member
L3 distance between front end of reinforcing plate and front end of lower shield layer
P1, P2, P3 contact

What is claimed is:

1. A shielded flat cable for insertion into a connector, the shielded flat cable comprising:

a plurality of flat conductors arranged in parallel;

an upper insulating layer provided on upper surfaces of the plurality of conductors;

an upper shield layer provided on an upper surface of the upper insulating layer;

an upper protective layer provided on an upper surface of the upper shield layer, an upper contact portion exposed from the upper protective layer, the upper contact portion being provided to contact a first contact member of the connector, and being electrically coupled to the upper shield layer;

a lower insulating layer provided on lower surfaces of the plurality of conductors;

a lower shield layer provided on a lower surface of the lower insulating layer;

a lower protective layer provided on a lower surface of the lower shield layer;

a lower contact portion exposed from the lower protective layer, the lower contact portion being provided to contact a second contact member of the connector, and being electrically coupled to the lower shield layer;

a terminal in which the plurality of conductors are exposed at an end in a longitudinal direction; and a reinforcing plate provided on the lower surface of the lower insulating layer and the lower surfaces of the plurality of conductors at the terminal;

wherein the plurality of conductors extend in a straight line along the lower insulating layer and the reinforcing plate, wherein the lower contact portion and the terminal overlap in a side view, and wherein the lower contact portion is a grounding member bonded on the lower surface of the reinforcing plate and the lower surface of the lower shield layer, and the grounding member extends underneath the terminal.

2. The shielded flat cable as claimed in claim 1, wherein the upper contact portion is a portion of the upper shield layer, the portion of the upper shield layer being exposed from the upper protective layer, the upper contact portion extending in a straight line from a first end to a second end, the first end contacting the upper protective layer, and the second end being on a terminal side in a side cross-sectional view in the longitudinal direction.

3. The shielded flat cable as claimed in claim 1, wherein the lower contact portion has a bent portion corresponding to an end of the reinforcing plate, and the upper contact portion and the bent portion overlap in the side view.

4. The shielded flat cable as claimed in claim 1, wherein an exposed portion of the upper shield layer is larger than an exposed portion of the lower shield layer, the exposed portion of the upper shield layer being exposed from the upper protective layer, and the exposed portion of the lower shield layer being exposed from the lower protective layer.

5. A shielded flat cable for insertion into a connector, the shielded flat cable comprising:

a plurality of flat conductors arranged in parallel;

an upper insulating layer provided on upper surfaces of the plurality of conductors, an upper shield layer provided on an upper surface of the upper insulating layer;

an upper protective layer provided on an upper surface of the upper shield layer, an upper contact portion exposed from the upper protective layer, the upper contact portion being provided to contact a first contact member of the connector, and being electrically coupled to the upper shield layer;

a lower insulating layer provided on lower surfaces of the plurality of conductors, a lower shield layer provided on a lower surface of the lower insulating layer;

a lower protective layer provided on a lower surface of the lower shield layer;

a lower contact portion exposed from the lower protective layer, the lower contact portion being provided to contact a second contact member of the connector, and being electrically coupled to the lower shield layer;

a terminal in which the plurality of conductors are exposed at an end in a longitudinal direction; and a reinforcing plate provided on the lower surface of the lower insulating layer and the lower surfaces of the plurality of conductors at the terminal;

wherein the plurality of conductors extend in a straight line along the lower insulating layer and the reinforcing plate, wherein the lower contact portion and the terminal overlap in a side view, wherein the lower contact portion is the lower shield layer, and the lower shield layer extends underneath the terminal, and wherein the lower shield layer extends under an entirety of a non-exposed portion of the plurality of flat conductors.

6. The shielded flat cable as claimed in claim 5, wherein an exposed portion of the upper shield layer is smaller than an exposed portion of the lower shield layer, the exposed portion of the upper shield layer being exposed from the upper protective layer, and the exposed portion of the lower shield layer being exposed from the lower protective layer.

* * * * *